US008787781B2

(12) United States Patent
Kubo et al.

(10) Patent No.: US 8,787,781 B2
(45) Date of Patent: Jul. 22, 2014

(54) IMAGE FORMING APPARATUS AND METHOD FOR CONTROLLING THE SAME

(75) Inventors: Hideki Kubo, Kawasaki (JP); Yoichi Takikawa, Kawasaki (JP); Ayato Imai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 233 days.

(21) Appl. No.: 13/484,145

(22) Filed: May 30, 2012

(65) Prior Publication Data

US 2012/0315054 A1 Dec. 13, 2012

(30) Foreign Application Priority Data

Jun. 7, 2011 (JP) ..... 2011-127514

(51) Int. Cl.
*G03G 15/00* (2006.01)

(52) U.S. Cl.
USPC ..... 399/49

(58) Field of Classification Search
CPC ..... G03G 2215/00029
USPC ..... 399/38, 46, 49
See application file for complete search history.

(56) References Cited

U.S. PATENT DOCUMENTS

2010/0329710 A1* 12/2010 Yamazaki ..... 399/49
2010/0329712 A1* 12/2010 Fukutani et al. ..... 399/49
2011/0076040 A1* 3/2011 Uchidate et al. ..... 399/49

FOREIGN PATENT DOCUMENTS

JP 2007-140402 A 6/2007

* cited by examiner

*Primary Examiner* — Sandra Brase
(74) *Attorney, Agent, or Firm* — Canon USA Inc IP Division

(57) ABSTRACT

An image processing apparatus capable of forming an image using a plurality of devices which make periodic movements by an electrophotographic method includes a control unit configured to control image formation using the devices, a gradation characteristic storage unit configured to store therein a gradation characteristic of each of the devices, an acquisition unit configured to acquire a phase in each of the devices corresponding to a position of a target pixel, a calculation unit configured to calculate an amount of density variation caused by each of the devices corresponding to the phase and an input value expressing the target pixel, and a correction unit configured to correct an input value expressing the image based on the density variation amount corresponding to each of the devices, wherein the calculation unit calculates the density variation amount based on the gradation characteristic.

8 Claims, 9 Drawing Sheets

| MODULE NO. | MODULE NAME | FREQUENCY [cycle/mm] |
|---|---|---|
| 01 | CHARGING ROLLER | 0.050 |
| 02 | CHARGING ROLLER DRIVE MOTOR | 1.476 |
| 03 | DRUM DRIVE GEAR 1 | 0.240 |
| 04 | DRUM DRIVE GEAR 2 | 0.400 |
| 05 | PHOTOSENSITIVE DRUM | 0.020 |
| 06 | DRUM DRIVE MOTOR | 1.000 |
| 07 | LASER INTERVAL | 23.810 |
| 08 | POLYGON MIRROR | 1.476 |
| 09 | DEVELOPING ROLLER | 0.038 |
| 10 | DEVELOPING ROLLER GEAR 1 | 0.769 |
| 11 | DEVELOPING ROLLER GEAR 2 | 1.231 |
| 12 | TRANSFER ROLLER | 0.024 |
| 13 | FIXING ROLLER | 0.028 |
| 14 | SHEET CONVEYANCE ROLLER | 0.067 |
| ⋮ | ⋮ | ⋮ |

IMAGE FORMING APPARATUS AND METHOD FOR CONTROLLING THE SAME

BACKGROUND OF THE INVENTION

1. Field of the Invention

The present invention relates to an image forming apparatus for forming an image by an electrophotographic process with laser light, and to a method for controlling the image forming apparatus.

2. Description of the Related Art

Image forming apparatuses such as laser beam printers and copying machines employing electrophotographic methods have been conventionally known. Such image forming apparatuses form images by scanning image bearing members with laser beams. Generally, an image forming apparatus employing an electrophotographic method forms an image by a plurality of processes such as charging, exposure, development, transferring, fixing, and cleaning processes.

A general electrophotographic process is performed as follows. First, a charging unit uniformly charges a photosensitive member serving as an image bearing member. Then, an exposure unit exposes the photosensitive member to a laser beam according to an image signal to form an electrostatic latent image on the photosensitive member. Herein, a direction in which the photosensitive member is scanned with the laser beam is referred to as a main scanning direction. The electrostatic latent image is formed while the photosensitive member is being rotated sequentially in a sub-scanning direction perpendicular to the main scanning direction. Subsequently, a developing unit develops the electrostatic latent image on the photosensitive member, and forms a toner image on the photosensitive member. Herein, the developing unit charges a toner, and supplies the charged toner to the photosensitive member using a developing roller that rotates at a substantially constant speed. The developing unit attaches the toner to the electrostatic latent image, thereby forming the toner image. The toner image on the photosensitive member is transferred to a recording medium and is fixed thereon. Accordingly, an image is formed on the recording medium. A cleaning unit collects a transfer residual toner remained on the photosensitive member.

In such an image forming apparatus, there are cases where horizontal stripes (hereinafter referred to as banding) caused by difference in density are generated on an image due to various causes. Such banding significantly deteriorates image quality.

For example, banding occurs when a variation in rotation speed of a photosensitive member generates a variation in main scanning interval (hereinafter referred to as a scanning interval) on a photosensitive member to be scanned by an exposure unit. When the rotation speed of the photosensitive member is high, the scanning interval increases. Thus, an amount of exposure per unit area decreases. If an image is formed in such a situation, a density of the image will be lower than that of an image that is originally expected. When the rotation speed of the photosensitive member is low, on the other hand, the scanning interval decreases, so that an amount of exposure per unit area increases. If an image is formed in such a situation, a density of the image will be higher than that of an image originally expected.

In addition, there are cases where banding occurs by variation in rotation speed of a developing roller. When the rotation speed of the developing roller is low, an amount of toner to be supplied decreases. Consequently, an amount of the toner to be adhered to an electrostatic latent image decreases, and a density of an image to be formed will be lower than that of an image originally expected. When a rotation speed of the developing roller is high, on the other hand, an amount of the toner to be supplied increases. Consequently, an amount of the toner to be adhered to an electrostatic latent image increases, and an imaged to be formed will have a higher density than that of an image originally expected.

Accordingly, Japanese Patent Application Laid-Open No. 2007-140402 discusses a method for correcting an exposure amount based on a result of reading an image formed on an intermediate transfer belt.

However, occurrences of banding differ depending on a gradation of an image to be formed. Although the method discussed in Japanese Patent Application Laid-Open No. 2007-140402 corrects the banding based on a result of reading an image having a specific gradation, the correction is not made in consideration of a gradation. Consequently, an appropriate correction cannot be made according to the gradation of an image to be formed, and the banding remains on the image.

Moreover, banding characteristics of respective gradations differ depending on a component (hereinafter referred to as a module) such as a photosensitive member or a developing member that is needed for image formation but a cause of the banding. Accordingly, an appropriate banding intensity according to an input gradation cannot be calculated without determination of which module causes the banding, or an appropriate correction cannot be made.

SUMMARY OF THE INVENTION

The present invention is directed to acquisition of a good image by suitably suppressing banding caused by a plurality of modules according to a gradation of an input image.

According to an aspect of the present invention, an image processing apparatus capable of forming an image using a plurality of devices which make periodic movements by an electrophotographic method includes a control unit configured to control image formation using the devices, a gradation characteristic storage unit configured to store therein a gradation characteristic of each of the devices, an acquisition unit configured to acquire a phase in each of the devices corresponding to a position of a target pixel, a calculation unit configured to calculate an amount of density variation caused by each of the devices corresponding to the phase and an input value expressing the target pixel, and a correction unit configured to correct an input value expressing the image based on the density variation amount corresponding to each of the devices, wherein the calculation unit calculates the density variation amount based on the gradation characteristic.

According to the present invention, therefore, the banding caused by a plurality of modules can be suitably suppressed according to a gradation of the input image, thereby acquiring a good image.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
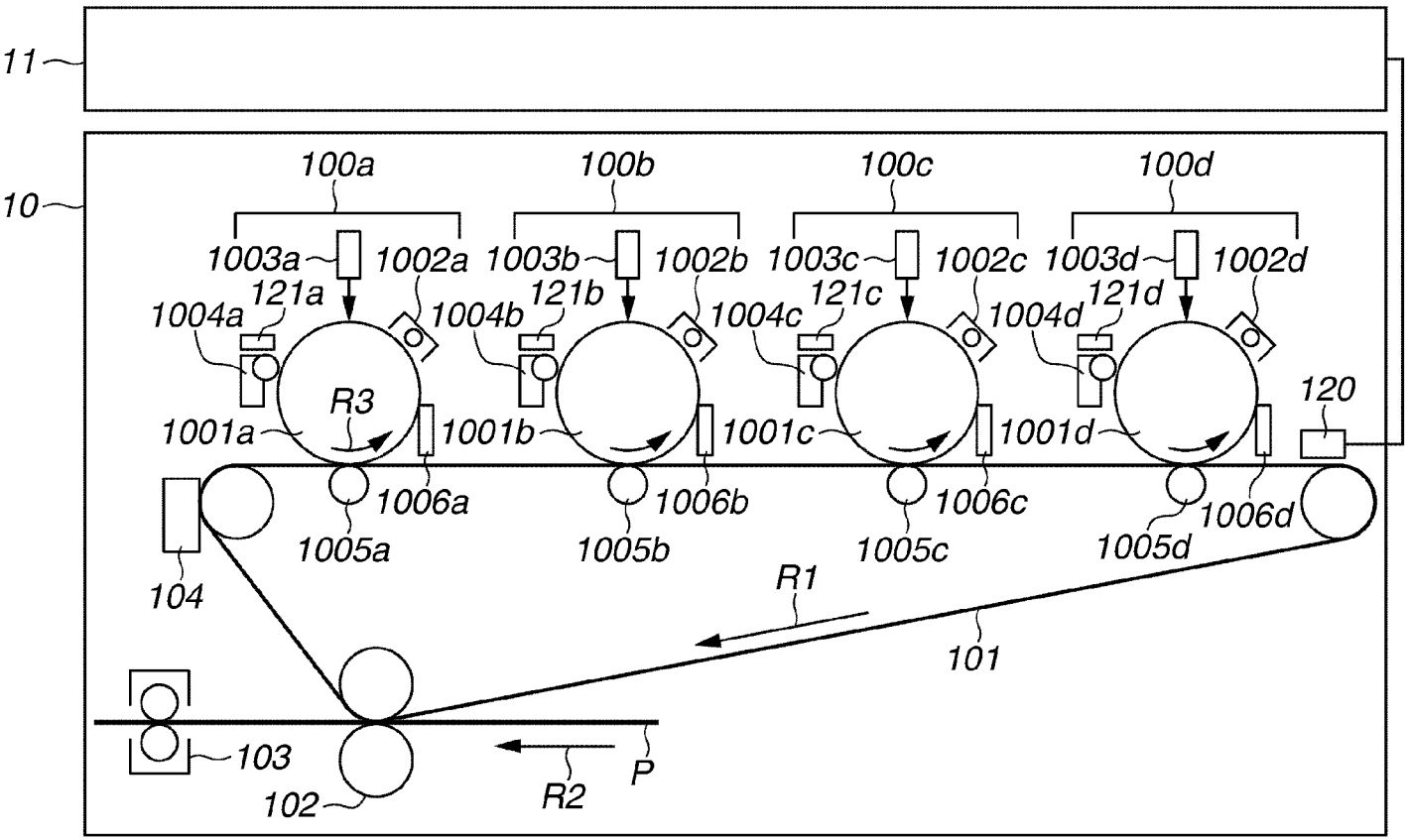
FIG. 1 is a block diagram illustrating a configuration of an image forming apparatus.

FIG. 1 illustrates a configuration of an image forming apparatus according to a first exemplary embodiment. The image forming apparatus illustrated in FIG. 1 includes an engine 10 and a controller 11. The engine 10 includes image forming units 100*a*, 100*b*, 100*c*, and 100*d* of respective colors of cyan (C), magenta (M), yellow (Y), and black (K), a density sensor 120, a secondary transfer device 102, and an intermediate transfer belt cleaning device 104, which are disposed along an intermediate transfer belt 101 from an upstream of a rotation direction R1 of the intermediate transfer belt 101. In addition, a fixing device 103 is disposed on a downstream side of the secondary transfer device 102.

The image forming units 100*a*, 100*b*, 100*c*, and 100*d* of the respective colors of cyan (C), magenta (M), yellow (Y), and black (K) perform substantially the same processes. The image forming unit 100*a* includes a photosensitive drum 1001*a*, a charging device 1002*a*, an exposure device 1003*a*, a developing device 1004*a*, a primary transfer device 1005*a*, a cleaning device 1006*a*, and a rotational phase acquisition unit 121*a*. Each of the image forming units 100*b*, 100*c*, and 100*d* has a configuration similar to that of the image forming unit 100*a*.

Now, an operation of the image forming apparatus is described. First, an image forming process to be performed by the image forming apparatus is described below.

The image forming units 100*a*, 100*b*, 100*c*, and 100*d* form toner images on respective photosensitive drums 1001*a*, 1001*b*, 1001*c*, and 1001*d* with the respective color toners, and primarily transfer the toner images in sequence to the intermediate transfer belt 101. Generally, toners to be used in the image forming apparatus are four colors of C, M, Y, and K. In the present exemplary embodiment, the image forming units 100*a*, 100*b*, 100*c*, and 100*d* use a C-toner, an M-toner, a Y-toner, and a K-toner, respectively. However, the number of image forming units and colors to be used is not limited to four. For example, a light color toner or a clear toner may be used. Moreover, the arrangement of the image forming units according to the present exemplary embodiment is not limited thereto. The image forming units may be arranged in an arbitrary order.

The toner images are formed in the order of the image forming units 100*a*, 100*b*, 100*c*, and 100*c* in a parallel manner with a certain time lag therebetween.

The photosensitive drum 1001*a* of the image forming unit 100*a* rotates in a direction indicated by an arrow R3. The photosensitive drum 1001*a* has an organic photoconductive layer on an outer circumferential surface thereof, the organic photoconductive layer having a negative charge polarity.

The charging device 1002*a* is applied with voltage having a negative polarity, and applies charging particles to a surface of the photosensitive drum 1001*a*, thereby uniformly charging the surface of the photosensitive drum 1001*a* to a negative polarity potential. The charged photosensitive drum 1001*a* rotates in the arrow R3 direction.

The exposure device 1003*a* drives a laser beam based on a control signal acquired from the controller 11, and scans the photosensitive drum 1001*a* with the laser beam. Accordingly, an electrostatic latent image is formed on the surface of the charged photosensitive drum 1001*a*.

The developing device 1004*a* supplies the toner charged into the negative polarity to the photosensitive drum 1001*a* using a developing roller that rotates at a substantially constant speed. Accordingly, the developing device 1004*a* causes the toner to be adhered to the electrostatic latent image on the photosensitive drum 1001*a*, and reversely develops the electrostatic latent image.

The primary transfer device 1005*a* primarily transfers the toner image carried on the photosensitive drum 1001*a* being charged into the negative polarity to the intermediate transfer belt 101 using a transfer roller that is charged into a positive polarity.

The cleaning device 1006*a* removes a residual toner image remained on the photosensitive drum 1001*a* having passed through the primary transfer device 1005*a*.

Although the description is made on the image forming unit 100*a* for cyan color, the image forming units 100*b*, 100*c*, and 100*d* perform processes similar to those in the image forming unit 100*a*. When a color image is formed, each of the charging, exposing, developing, primary transferring, and cleaning processes is performed by the image forming units 100*a*, 100*b*, 100*c*, and 100*d* in sequence. As a result, an image consisting of the overlaid toner images of four colors is formed on the intermediate transfer belt 101.

The secondary transfer device 102 secondarily transfers the toner image carried on the intermediate transfer belt 101 to a recording medium P moving in a direction indicated by an arrow R2.

The fixing device 103, for example, applies pressure and heat to the recording medium P having the toner image secondarily transferred thereon, thereby fixing the toner image onto the recording medium P.

The intermediate transfer belt cleaning device 104 removes a residual toner remained on the intermediate transfer belt 101 having passed through the secondary transfer device 102. The image forming processes has been described.

Such an image forming apparatus for forming an image using the electrophotographic method, therefore, banding can occur by various causes. A description is now given of examples of the banding to occur at the time of exposure, development, and primary transfer. In the following descriptions, suffixes a, b, c, and d attached to the respective image forming units and components of the image forming units are omitted. For example, an image forming unit 100 represents the image forming units 100*a*, 100*b*, 100*c*, and 100*d*.

First, the banding to occur at the time of exposure can be caused by variation in rotation speed of the photosensitive drum 1001. When the rotation speed of the photosensitive drum 1001 is high, a scanning interval increases, thereby decreasing an amount of exposure per unit area. Thus, if an image is formed in such a situation, a density of the image will be lower than that of an image that is originally expected. When the rotation speed of the photosensitive drum 1001 is low, on the other hand, a scanning interval decreases, thereby increasing an amount of exposure per unit area. Thus, if an image is formed in such a situation, a density of the image will be higher than that of an image originally expected.

Further, the banding to occur at the time of development can be caused by deviation of a rotation axis of a developing roller and variation in rotation speed of the developing roller. In a developing process, the developing device 1004 supplies a toner to a development region between the photosensitive drum 1001 and thereof. The development region in which development is performed is a developing nip in the case of contact development, and is a developing gap in the case of non-contact development. An amount of the toner to be supplied to the development region is preferably constant per unit time. Generally, a development roller is a cylindrical column having a perfect circle in cross section, and is controlled to rotate at a constant speed around a straight line through the center of mass between two bases as an axis. However, there are cases where a supply amount of the toner may vary due to various causes in the developing roller.

Figure 2A:
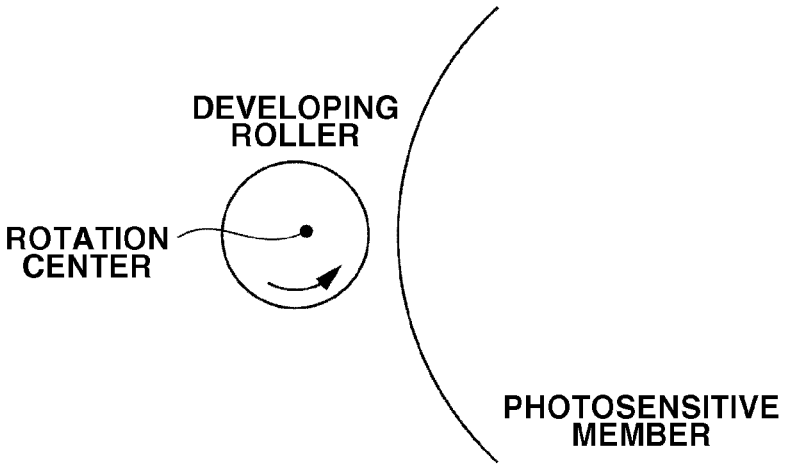
FIGS. 2A and 2B are schematic diagrams illustrating deviation of a rotation axis of a developing roller.
Figure 2B:
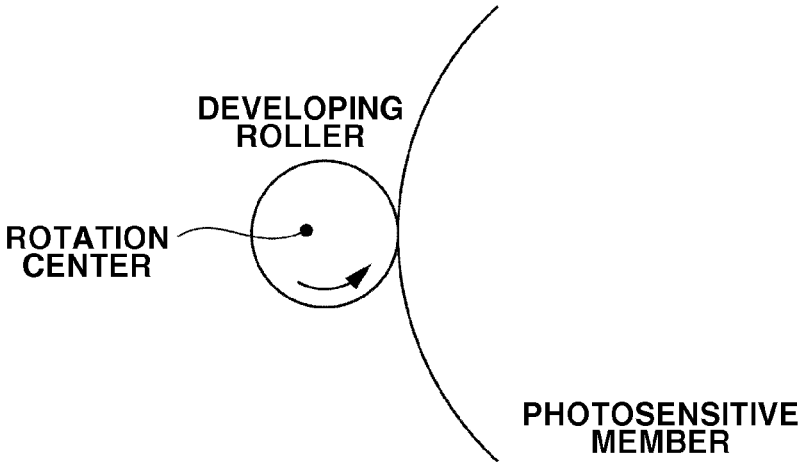

FIGS. 2A and 2B are schematic diagrams illustrating deviation of a rotation axis of a developing roller. FIG. 2A illustrates a state in which a developing roller surface and a photosensitive member surface are apart from each other, whereas FIG. 2B illustrates a state in which the developing roller surface and the photosensitive member surface are close to each other. When the rotation axis of the developing roller deviates, the states in FIGS. 2A and 2B are alternately repeated by synchronizing with a rotation period of the developing roller. Therefore, an amount of the toner to be supplied to the development region decreases in the state illustrated in FIG. 2A, whereas an amount of the toner increases in the state illustrated in FIG. 2B.

Moreover, there are cases where variation in the rotation speed of the developing roller occurs due to fluctuation in speed of a motor for driving the developing roller and malfunction of a gear for connecting the developing roller and the motor, for example. In such cases, an amount of the toner to be supplied to the development region increases when the rotation speed of the developing roller is high, whereas an amount of the toner decreases when the rotation speed is low. Consequently, the deviation of the rotation axis or the variation in the rotation speed of the developing roller changes the amount of the toner to be supplied to the development region, causing occurrences of the banding.

The banding to occur at the time of primary transfer can be caused by deviation of a rotation axis of a transfer roller and uneven hardness of a transfer roller surface. In a transfer process, the pressure between the photosensitive drum and the primary transfer device changes if the rotation axis of the transfer roller deviates. Such a change in the pressure causes an error in formation of a toner image to be transferred. Moreover, if the hardness of the transfer roller surface is not even, a contact area between the photosensitive drum and the primary transfer device changes, causing an error in formation of a toner image to be transferred. Such an error in formation of the toner image by transfer generates unintended dark and light portions in an image, and thus the banding occurs.

The examples of the banding to occur at the time of exposure, development, and primary transfer have been described. However, a variation having periodicity may be generated in any location in addition to the above examples, and any variation may cause the banding.

In the present exemplary embodiment, a banding correction process is performed with respect to the banding caused by three modules such as the photosensitive drum, the developing roller, and the transfer roller. Since banding characteristics vary depending on gradations of input image data, the correction process is performed according to the gradation. In addition, since gradation characteristics of the banding vary depending on the modules, the correction process is performed according to the module.

Figure 3A:
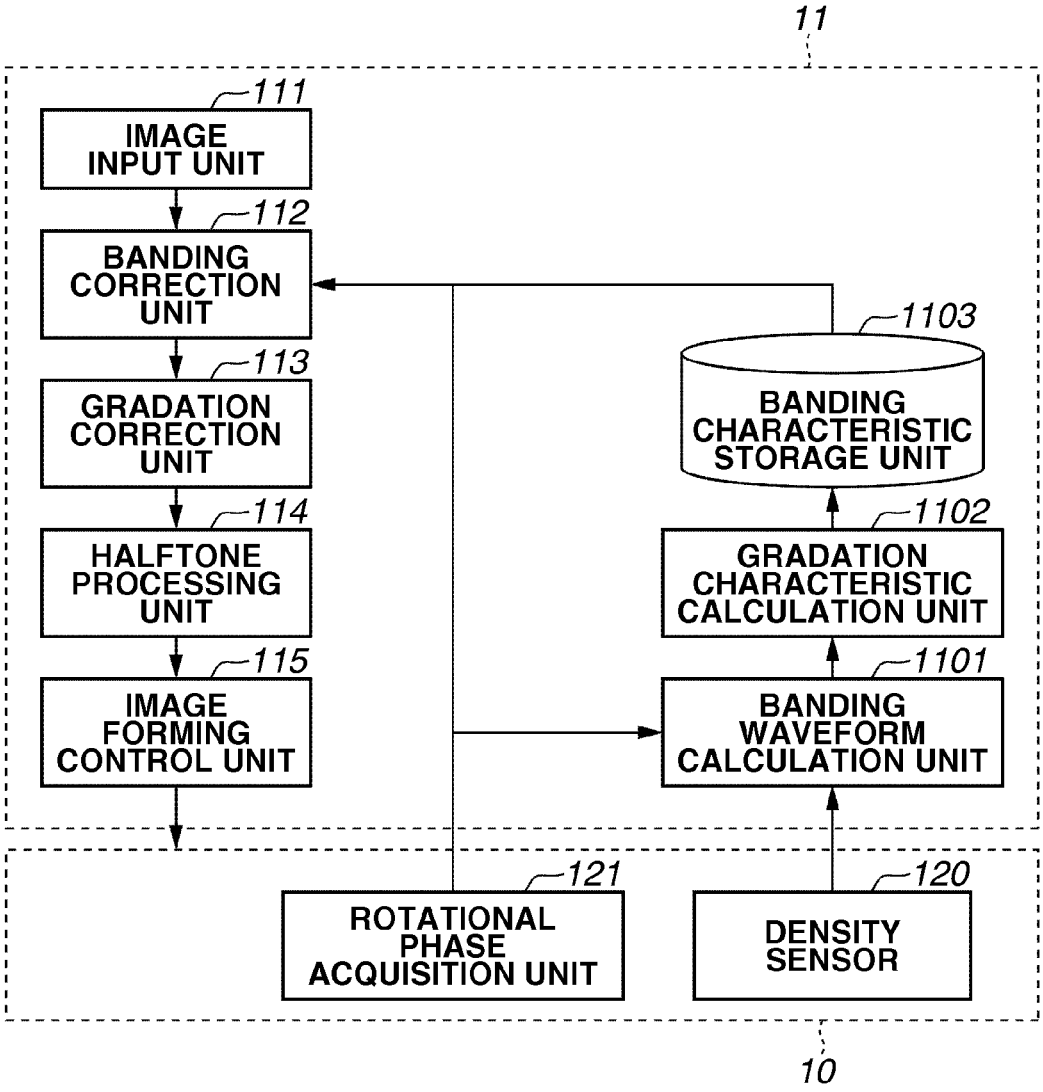
FIGS. 3A and 3B are block diagrams each illustrating a configuration relating to a banding correction process.

The banding correction process is described below. FIG. 3A is a block diagram illustrating a configuration necessary to perform the banding correction process.

The density sensor 120 detects density of a toner image primarily transferred to the intermediate transfer belt 101 by passing through the image forming units 100*a*, 100*b*, 100*c*, and 100*d*. The density sensor 120 outputs the detected density to a banding waveform calculation unit 1101.

The rotational phase acquisition units 121*a*, 121*b*, 121*c*, and 121*d* acquire rotational phases of respective target modules. Herein, the modules include the photosensitive drums 1001*a*, 1001*b*, 1001*c*, and 1001*d*, developing rollers included in the respective developing devices 1004*a*, 1004*b*, 1004*c*, and 1004*d*, and transfer rollers included in the respective primary transfer devices 1005*a*, 1005*b*, 1005*c*, and 1005*d*. The rotational phase acquisition unit 121 outputs rotational phases of the respective modules to the banding waveform calculation unit 1101 and a banding correction unit 112.

The banding waveform calculation unit 1101 calculates a banding waveform for each module based on a density signal of a patch image measured by the density sensor 120 and the rotational phase acquired from the rotational phase acquisition unit 121. The banding waveform is a waveform indicating a characteristic of banding caused by a target module. The banding waveform calculation unit 1101 outputs the calculated banding waveforms of the respective modules to a gradation characteristic calculation unit 1102.

The gradation characteristic calculation unit 1102 calculates banding waveforms for a plurality of respective gradations based on the acquired banding waveforms of the respective modules from the banding waveform calculation unit 1101. The gradation characteristic calculation unit 1102 outputs the calculated banding waveforms to a banding characteristic storage unit 1103.

The banding characteristic storage unit 1103 receives the banding waveforms of the plurality of gradations for the respective modules from the gradation characteristic calculation unit 1102. Subsequently, the banding characteristic storage unit 1103 stores therein the banding waveforms.

An image input unit 111 receives input image data from an external unit, and generates color image data of each of CMYK colors. The image input unit 111 outputs the generated color image data to the banding correction unit 112.

The banding correction unit 112 corrects the color image data of each color acquired from the image input unit 111 based on a rotational phase of each module acquired from the rotational phase acquisition unit 121. The banding correction unit 112 uses the banding waveforms of the respective plural gradations for each module to correct the color image data, the banding waveforms being acquired from the banding characteristic storage unit 1103. The banding correction unit 112 outputs the image data in which the banding is corrected (hereinafter referred to as banding corrected image data) for each color to a gradation correction unit 113.

The gradation correction unit 113 receives the banding corrected image data of each color from the banding correction unit 112, and performs a gradation correction with respect to the banding corrected image data according to the image forming apparatus. The gradation correction unit 113 outputs the image data in which the gradation is corrected (hereinafter referred to as gradation corrected image data) for each color to a halftone processing unit 114. Herein, the gradation correction is a correction to be made to provide a linear relation between image data to be input and image density to be output from the image forming apparatus.

The halftone processing unit 114 performs a halftone process on the gradation corrected image data of each color output from the gradation correction unit 113, and generates halftone image data that can be output by the gradation correction unit 113. The halftone processing unit 114 outputs the generated halftone image data to an image forming control unit 115.

The image forming control unit 115 outputs a control signal to the engine 10 based on the halftone image data received from the halftone processing unit 114, and performs an image forming process.

A banding correction process is described in detail below. The banding correction process according to the present exemplary embodiment includes two processes, that is, a banding characteristic calculation process and a correction image data generation process.

<Banding Characteristic Calculation Process>

Figure 4A:
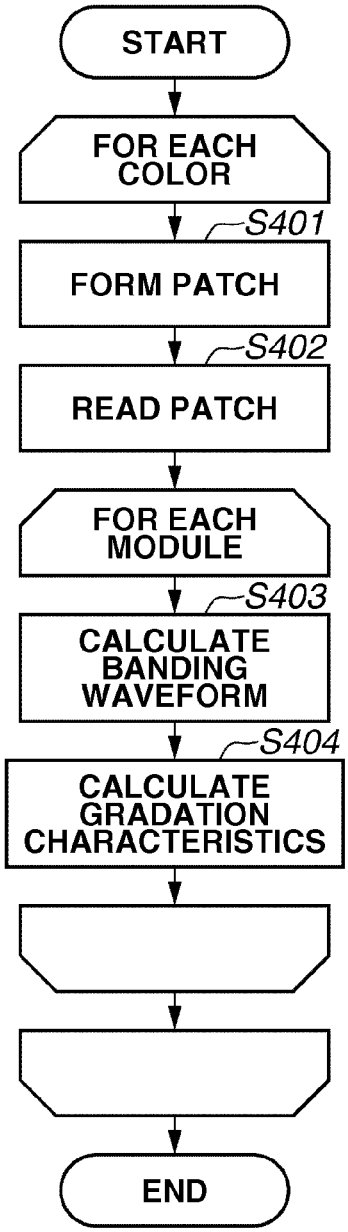
FIGS. 4A through 4C are flowcharts illustrating a banding characteristic calculation process and a correction image generation process.

FIG. 4A illustrates a flowchart of a banding characteristic calculation process. The banding characteristic calculation process is executed with respect to image data of each color formed by the image forming units 100*a*, 100*b*, 100*c*, and 100*d*. As similar to the above description, suffixes a, b, c, and d attached to the respective components are omitted. For example, an image forming unit 100 represents the image forming units 100*a*, 100*b*, 100*c*, and 100*d*.

In step S401, a patch forming process is performed.

Figure 5A:
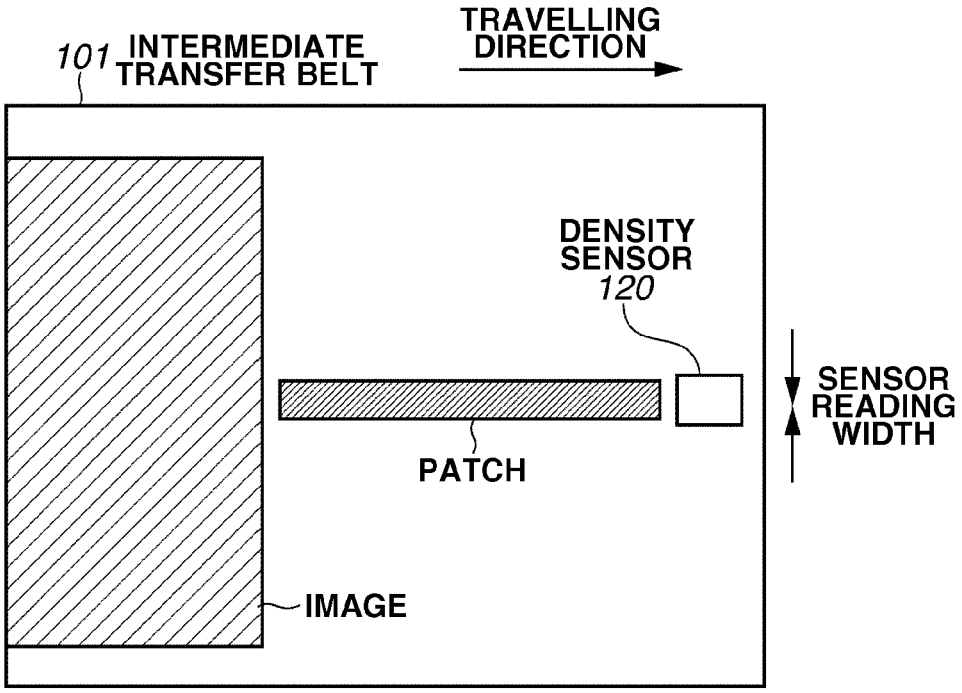
FIGS. 5A and 5B are schematic diagrams each illustrating a patch to be formed.

FIG. 5A is a schematic diagram illustrating patch forming and reading. The patch forming process is executed by primarily transferring a toner image formed by the image forming unit 100 to the intermediate transfer belt 101 as similar to the above-described image forming process. A patch image to be formed is an image uniformly expressed by a specific gradation that is set beforehand, and is designed such that a length of a sub-scanning direction is fully longer than a period of each module. Herein, a patch image having a density of 0.6 is formed. A length of a main scanning direction can be long enough to be detected by the density sensor 120 in step S402 which will be described below.

In parallel with the patch forming process, the rotational phase acquisition unit 121 acquires a rotational phase ph of each module from the beginning of the patch forming, and outputs the acquired rotational phase ph to the banding waveform calculation unit 1101. For example, a rotational phase can be acquired by a method using a rotary encoder disposed in each module, or a method of calculation based on a driving time and a home position sensor for outputting a signal at a specific rotation angle.

In step S402, a patch reading process is performed. The density sensor 120 measures the patch image transferred to the intermediate transfer belt 101 in step S401 at every minute interval, and outputs a density signal OD(y). The letter "y" indicates a measurement position on a patch image.

In step S403, a banding waveform calculation process is performed for each module. The banding waveform calculation unit 1101 calculates a banding waveform ΔOD (ph) for each module based on the density signal OD(y) acquired from the density sensor 120 and the rotational phase ph of each module acquired from the rotational phase acquisition unit 121.

Figure 6A:
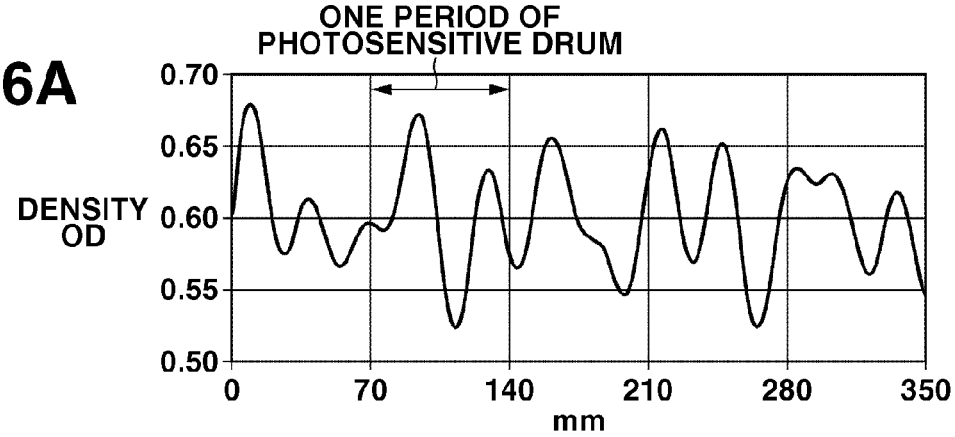
FIGS. 6A through 6D are schematic diagrams each illustrating a density signal in the banding characteristic calculation process.

FIG. 6A is a graph illustrating a density signal OD(y) acquired by measuring a patch by the density sensor 120 in step S402. Assume that a measurement position 0 mm in which measurement of a patch has started and a rotational phase 0 of each module correspond to each other for the sake of description. In FIG. 6A, a vertical axis of the graph indicates the density signal OD, whereas a horizontal axis indicates the measurement position y of a patch. Although the measured density varies in every measurement position, an average density is 0.6. Herein, a measured density variation ΔOD is a result of superimposition of density variations ΔOD caused by each of the photosensitive drum, the developing roller, and the transfer roller.

The banding waveform calculation unit 1101 calculates a banding waveform caused by each module based on the density signal OD(y) illustrated in FIG. 6A. In the present exemplary embodiment, three banding waveforms are thus acquired.

Now, a banding waveform calculation method is described with reference to an example of the banding caused the photosensitive drum.

The banding waveform calculation unit 1101 cuts out a density signal OD(y) every 70 mm that is a rotation period of the photosensitive drum. Herein, since a patch measurement result of 350 mm is provided by the density sensor 120, the banding waveform calculation unit 1101 can acquire five waveforms by cutting out the density signal OD(y) every 70 mm at the rotation period of the photosensitive drum 1001. Subsequently, the banding waveform calculation unit 1101 averages the five density signals ODn(ph) (n=1, 2, 3, 4, 5). Herein, a patch measurement position 0 corresponds to a rotational phase ph 0 of the photosensitive drum 1001, and a section up to 2π from 0 of the rotational phase ph is cut out. The cut-out five waveforms are averaged by Equation (1) to acquire a density signal ODave(ph).

Equation (1)

$$ODave(ph)=\Sigma_n ODn(ph) \quad (1)$$

Figure 6B:
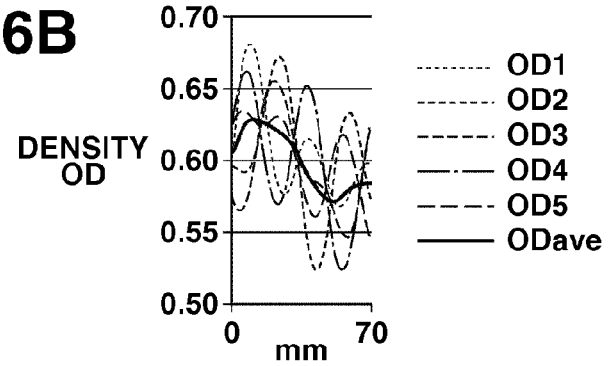

FIG. 6B illustrates a density signal ODave(ph) acquired by averaging the five density signals ODn (Ph) (n=1, 2, 3, 4, 5) that are acquired by cutting out the density signal OD (y) illustrated in FIG. 6A. Since each of the cut-out density signals ODn (ph) is influenced by the other modules each having a period different from that of the photosensitive drum, a waveform thereof is different from one another. Accordingly, the five waveforms are averaged to cancel the influences exerted by the other modules, so that a waveform substantially the same as the density variation caused by the photosensitive drum can be extracted. The description is made on the example in which the signals for five periods of the photosensitive drum 1001 are averaged. However, a patch size and the number of signals to be used for average calculation may be set in consideration of a permissible patch size and the accuracy of the desired banding waveform calculation.

Moreover, the banding waveform calculation unit 1101 performs a process for correcting a slope of the density signal ODave(ph). The banding waveform calculation unit 1101 determines a slope of a straight line connecting a value of a starting point (phase is 0) and a value of an end point (phase is 2π, 70 mm in the case of the photosensitive drum) of the density signal ODave(ph). Subsequently, the banding waveform calculation unit 1101 corrects the density ODave(ph) such that the slope becomes 0 as Equation (2), and calculates a density signal OD'(ph).

Equation (2)

$$OD'(ph)=ODave(ph)-(ODave(2\pi)-ODave(0))\cdot ph/2\pi \quad (2)$$

In the correction image forming process described below, since banding waveforms are repeatedly connected and used, continuity is preferably ensured between the starting point and the end point of the banding waveforms by the slope correction process.

In addition to the calculation by Equation (2), the banding waveform calculation unit 1101 uses Equation (3) to calculates a banding waveform ΔOD(ph) in the patch measured gradation by setting an average density of the density signal OD'(ph) having the corrected slope to 0.

Equation (3)

$$\Delta OD(ph)=OD(ph)-\text{mean}(OD'(ph)) \quad (3)$$

Where mean(OD'(ph)) is an average density of the density signal OD'(ph). According to the above-described procedure, the banding waveform calculation unit 1101 can calculate the banding waveform caused by the photosensitive drum.

The banding waveform calculation unit 1101 calculates a banding waveform caused by each of the developing roller and transfer roller in addition to the banding waveform caused by photosensitive drum. The developing roller has a period of 40 mm, whereas the transfer roller has a period of 30 mm. As similar to the case of the photosensitive drum, the banding waveform calculation unit 1101 averages a plurality of waveforms that are cut out by the period based on the density signal OD(y) illustrated in FIG. 6A. The banding waveform calculation unit 1101 then calculates a banding waveform ΔOD(ph) for each module based on the density signal ODave(ph) calculated by averaging the plural waveforms.

Subsequently, the banding waveform calculation unit 1101 outputs the banding waveform ΔOD(ph) corresponding to each module to the gradation characteristic calculation unit 1102. The banding waveform corresponding to each module may be calculated by arbitrary calculation order.

In step S403, therefore, the banding waveform calculation unit 1101 separates the banding caused by each module one from another from one patch image read by the density sensor 120 in step S402, and calculates the banding waveform of each module.

In step S404, a gradation characteristic calculation process is performed on the banding waveform of each module. In each module, banding waveforms have characteristics that differ depending on gradations.

Figure 6C:
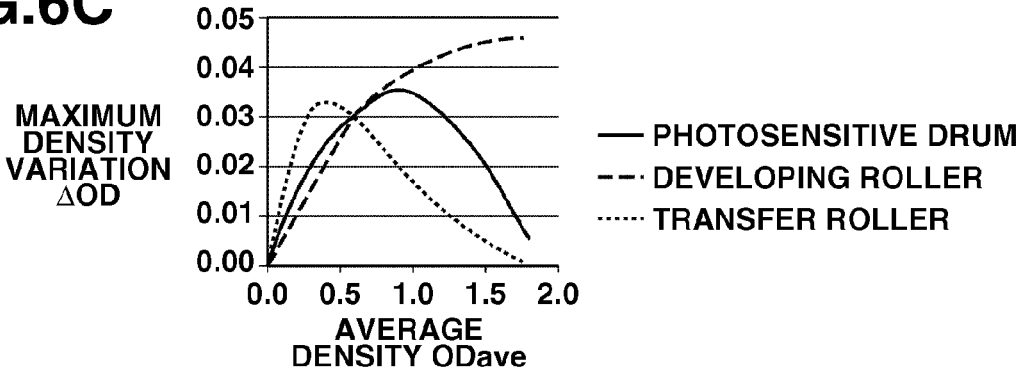

FIG. 6C illustrates a correlation between a gradation and a maximum density variation amount of each module. As illustrated in FIG. 6C, any of the modules has a maximum density variation amount that differs according to the gradation. In this example, a maximum density variation amount of a photosensitive drum period reaches the largest value when a density is approximately 0.9 and decreases as approaching a low-density side and a high-density side. A maximum density variation amount of a developing roller period, on the other hand, reaches the largest value on a high-density side, and decreases as an average density decreases.

Regarding the photosensitive drum, a variation in speed thereof is closely related to an exposure amount density at the time of exposure. The faster the rotation speed of the photosensitive drum, the lower the exposure amount. The slower the rotation speed of the photosensitive drum, the greater the exposure amount.

Figure 7A:
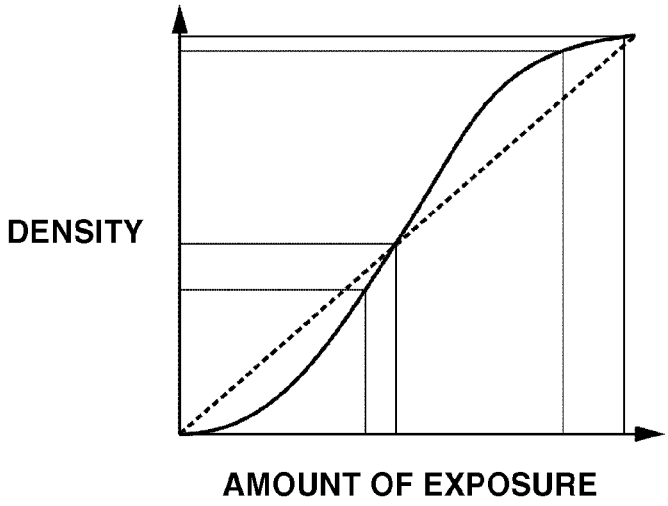
FIGS. 7A and 7B are schematic diagrams each illustrating a relationship between an exposure amount and an output image density in the image forming apparatus.

FIG. 7A illustrates a correlation between an exposure amount and an output image density in the image forming apparatus employing an electrophotographic method. As illustrated in FIG. 7A, the exposure amount and the density generally have a non-linear relation in the image forming apparatus employing the electrophotographic method. In regions of high density and low density, a density variation is small relative to a variation in the exposure amount. In a mid-density region, on the other hand, a density variation is large relative to a variation in the exposure amount. In other words, when an exposure amount variation occurs due to a variation in speed of the photosensitive drum, a maximum density variation amount tends to be large in the mid-density.

A variation in rotation speed of the developing roller is closely related to an amount of the toner to be supplied to a development region. As described above, when the rotation speed of the developing roller is high, an amount of the toner to be supplied increases. When the rotation speed of the developing roller is low, on the other hand, an amount of the toner to be supplied decreases. An amount of the toner to be developed on the photosensitive drum is small when an image has a low density, whereas the toner amount is large when an image has a high density.

Even if an amount of the toner to be supplied to the development region increases or decreases at the time of development of an image having a low density, an adverse effect on an amount of the toner to be developed is small as long as an amount of the toner needed for development is supplied. Therefore, even if the rotation speed of the developing roller varies at the time of development of an image having a low density, amplitude of a banding waveform is small.

When an image having a high density is developed, on the other hand, a decrease in an amount of the toner to be supplied to the development region causes a shortage of the toner needed for development. Consequently, an amount of the toner to be developed tends to be influenced by a variation in the rotation speed of the developing roller, and the development of the high-density image increases a maximum density variation amount of the banding caused by the variation in the rotation speed of the developing roller.

In the present exemplary embodiment, a variation in rotation speed of the transfer roller is closely related to an error in formation of toner. When the rotation speed of the transfer roller is low, the toner tends to form poorly. When the rotation speed of the transfer roller is high, the toner tends not to form poorly. In the low-density and mid-density regions, a space is provided between dots, and thus a non-dot area is large. Consequently, an error in formation of the toner can cause a change in the ratio of a dot area and the non-dot area, and a significant change in image density. In the high-density region, on the other hand, since a non-dot area is small, an adverse effect on image density due to an error in formation of dots is small.

Therefore, since the density variation generated in each module differs depending on density (gradation) of an image to be formed, any of the banding waveforms depends on the gradation. Accordingly, a banding waveform according to the gradation is calculated for each module. A description is now given of a method for calculating a banding waveform according to the gradation.

The gradation characteristic calculation unit 1102 calculates banding waveforms ΔOD(ph, ODmean) of a plurality of gradations based on a banding waveform ΔOD(ph) corresponding to each module, and a gradation correction coefficient k(ODmean) of each module. Herein, the banding waveform ΔOD(ph) is acquired from the banding waveform calculation unit 1101, and the gradation correction coefficient k(ODmean) is set beforehand. The gradation characteristic calculation unit 1102 outputs the banding waveforms in the plurality of gradations to the banding characteristic storage unit 1103 in a module basis.

The gradation correction coefficient k(ODmean) represents a ratio of the banding amplitude value calculated by the banding waveform calculation unit 1101 in step S403 and banding amplitude values in the other gradations (average density ODmean). Since the gradation correction coefficient k(ODmean) indicating the gradation characteristic does not change significantly over time, for example, the gradation correction coefficient k(ODmean) can be experimentally determined and set beforehand. As shown in Equation (4), the gradation characteristic calculation unit 1102 multiplies the banding waveform ΔOD(ph) in the gradation of the measured patch by the gradation correction coefficient k(ODmean) to calculate the banding characteristic ΔOD(ph, ODmean) of the other gradation.

Equation (4)

$$\Delta OD(ph, OD\text{mean}) = \Delta OD(ph) \cdot k(OD\text{mean}) \quad (4)$$

Figure 6D:
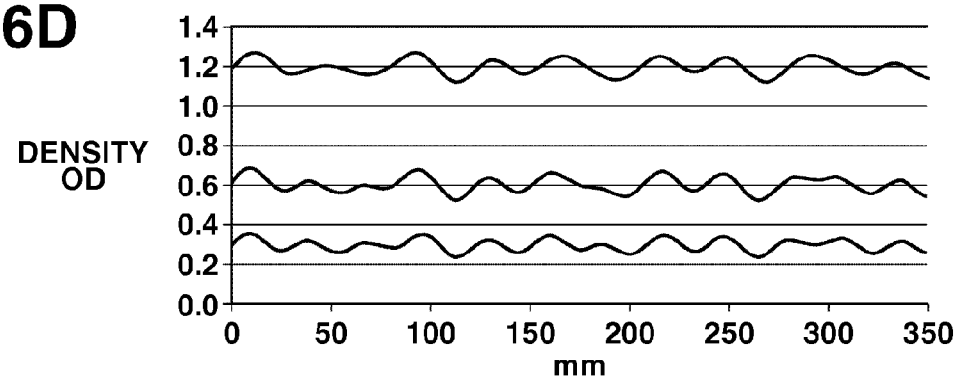

The gradation correction coefficient k(ODmean) is a coefficient to be acquired from the gradation characteristics illustrated in FIG. 6D. In the photosensitive drum, for example, the maximum amplitude value ΔOD is 0.03 when the banding waveform ΔOD(ph) at the time of formation of the image having a density of 0.6 calculated in step S403. According to the gradation characteristics of the photosensitive drum illustrated in FIG. 6D, when an image having a density of 0.3 is formed, the maximum amplitude value ΔOD of the density variation is estimated to be 0.015. Accordingly, the gradation characteristic calculation unit 1102 uses 0.015/0.03=0.5 of the gradation correction coefficient in the density of 0.3 as a coefficient k, and calculates a banding waveform ΔOD (ph, 0.3) generated at the time of formation of the image having a density of 0.3. Herein, assume that a gradation correction coefficient in a density of 0.3 and a gradation correction coefficient in a density of 1.2 are set as gradation correction coefficients k for each module. The banding characteristics in a density other than the densities of 0.3 and 1.2 can be calculated by linear interpolation.

According to the above-described banding characteristic calculation process, therefore, the gradation characteristic calculation unit 1102 can calculate the banding characteristics corresponding to the rotational phase of each module and the density of the image to be formed. Herein, six banding characteristics are calculated. The gradation characteristic calculation unit 1102 outputs all of the calculated banding characteristics to the banding characteristic storage unit 1103. Then, the banding characteristic storage unit 1103 stores the calculated banding characteristics therein.

<Correction Image Data Generation Process>

Figure 4B:
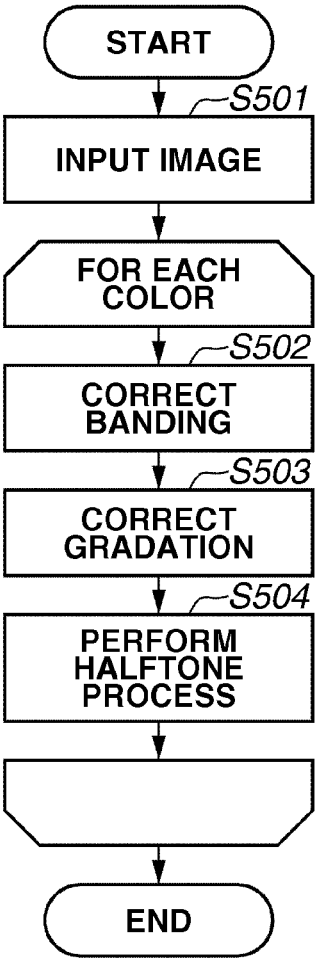

Next, a correction image data generation process is performed. FIG. 4B is a flowchart illustrating a process for generating correction image data.

In step S501, image data is input. The image input unit 111 receives the input image data from an external unit. Subsequently, the image input unit 111 generates image data I(x, y) corresponding to each color material stored in the image forming apparatus based on the received input image data. Herein, the letter "x" indicates a position in a main scanning direction of the image data, whereas the letter "y" indicates a position in a sub-scanning direction.

The following banding correction in step S502, gradation correction in step S503, and halftone image formation in step S504 are respectively performed on the image data I(x, y) of each color.

In step S502, the banding correction process is performed. The banding correction unit 112 selects one of the data that have not undergone the banding correction process among the image data I(x, y) of each color generated in step S501. The banding correction unit 112 performs the banding correction process on the selected image data I(x, y).

The banding correction unit 112 acquires a current rotational phase of each module from the rotational phase acquisition unit 121 on a pixel group basis (hereinafter referred as a line) provided on the same sub-scanning position y in the selected image data I(x, y). Subsequently, the banding correction unit 112 calculates a rotational phase ph(y) of each module at the time of development of a process target line of an image to be formed. The rotational phase ph(y) of each module at the time of development of the process target line can be easily calculated from a period and a current rotational phase of each module, and a time consumed to form an image. Such a process is repeated on a line basis for the number of pixels in a sub-scanning direction.

Next, the banding correction unit 112 refers to the banding characteristic ΔOD(ph, ODmean) stored in the banding characteristic storage unit 1103, and corrects each pixel based on the calculated rational phase ph(y) of each module and the gradation of the image data I(x, y). After each of all the pixels is corrected to a pixel value expressing a pixel (x, y), the banding correction unit 112 outputs the banding corrected image data.

Equation (5)

$$O(x, y) = I(x, y) - \sum_{m} \Delta ODm(ph(y), I(x, y)) \quad (5)$$

Where m is an identification number of a module. When an image is actually formed, density variations ΔOD caused by the respective modules are superimposed. Each density variation ΔOD caused by the corresponding module can be estimated by referring to the banding characteristic ΔOD(ph, ODmean) of each module and based on the rotational phase ph(y) and the desired density value I(x, y).

Therefore, the density variations 60D caused by the respective modules are added, and subtracted from the image data I beforehand. Accordingly, the banding to occur at the time of image formation can be cancelled, thereby reducing image deterioration caused by the banding. The banding correction unit 112 performs the banding corrections on all of the pixels with use of Equation (5), and outputs banding corrected image data O(x, y) to the gradation correction unit 113.

Figure 7B:
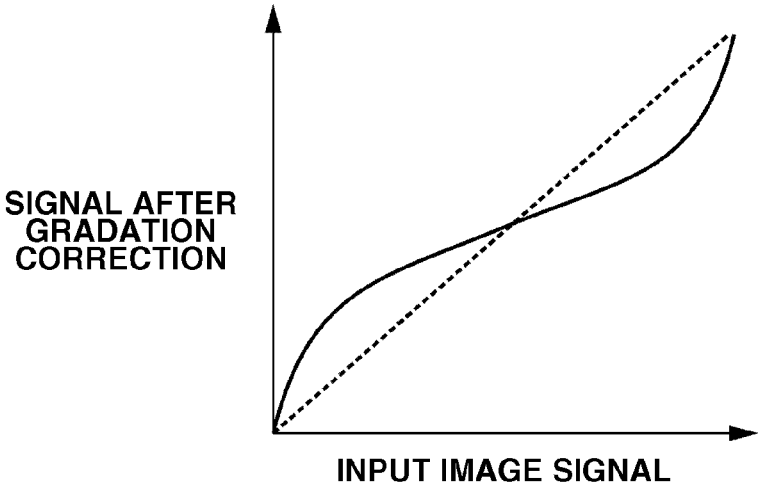

In step S503, the gradation correction unit 113 performs a gradation correction process. Generally, image data to be input and image density to be output from the image forming apparatus do not have a linear relation. The gradation correction unit 113, therefore, generally performs the gradation correction having an inverse characteristic in a relationship between an amount of exposure and the density (gradation) as illustrated in FIG. 7B. The gradation correction unit 113 performs the gradation correction process on the banding corrected image data O, and generates gradation corrected image data O'.

In step S504, a halftone process is performed. The halftone processing unit 114 performs a halftone process on the gradation corrected image data O'.

The processes in steps 502 through 504 are performed on all the image data pieces of each color, and the correction image data generation process ends.

The generated correction image data is output to the image forming control unit 115, and undergoes image formation.

According to the above-described present exemplary embodiment, a banding characteristic caused by each module is calculated, and a banding correction is performed according to a rotational phase of each module and density of an input image. The present exemplary embodiment, therefore, can appropriately suppress the banding caused by each of a plurality of modules having different rotation periods according to gradations.

Moreover, since banding characteristics of a plurality of gradations of each of modules can be calculated from a measurement result of one patch image, banding corrections corresponding to the plurality of gradations by the plurality of modules can be performed in relatively short processing time.

In the first exemplary embodiment, the description is made on a case where a photosensitive drum, a developing roller, and a transfer roller are three correction target modules. In a second exemplary embodiment, a module as a main cause of banding is specified based on the density of a measured patch image, and a correction is made on the banding caused by the module specified as the main cause.

Figure 3B:
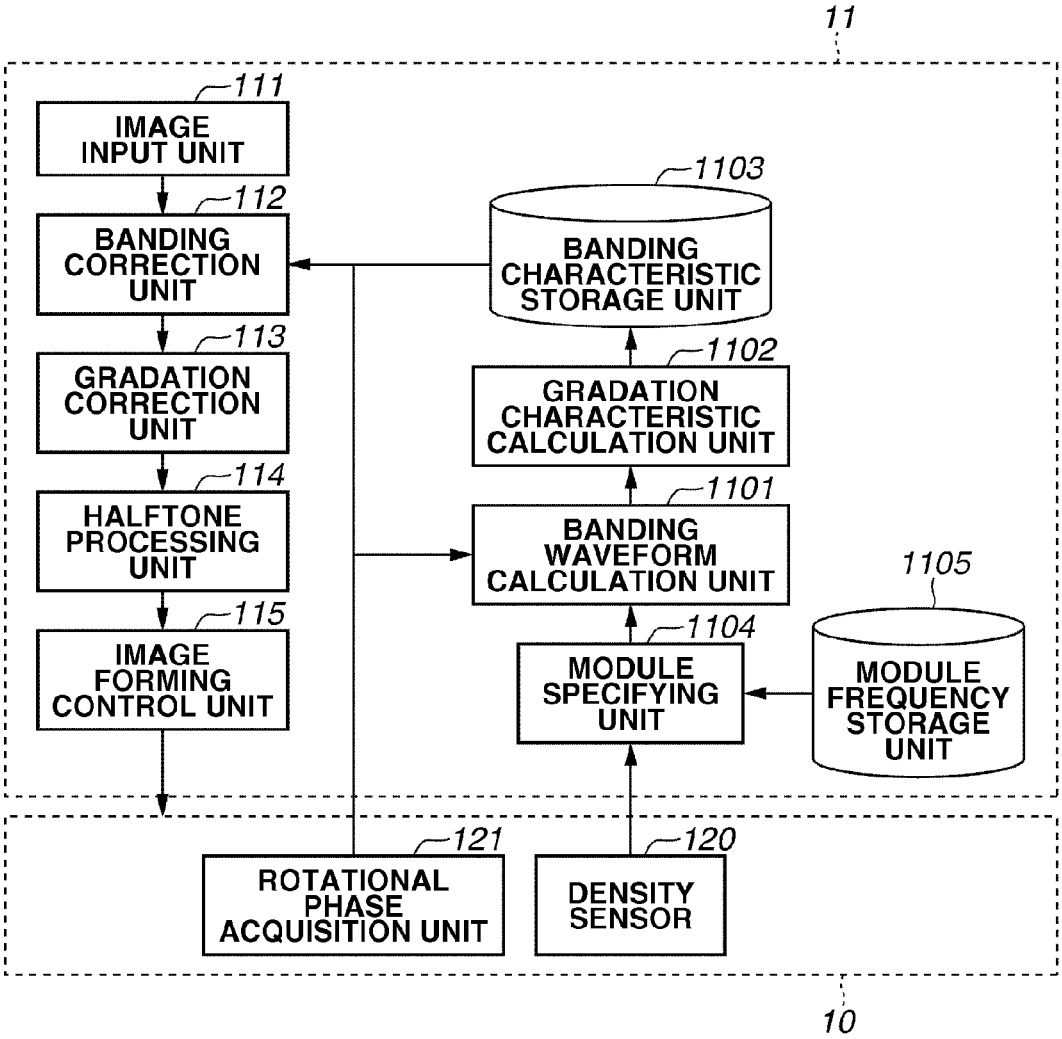

FIG. 3B is a block diagram illustrating a configuration necessary to correct the banding according to the present exemplary embodiment. Components similar to those of the first exemplary embodiment are given the same reference numerals as above and the description thereof is omitted.

Figures 8A, 8B:
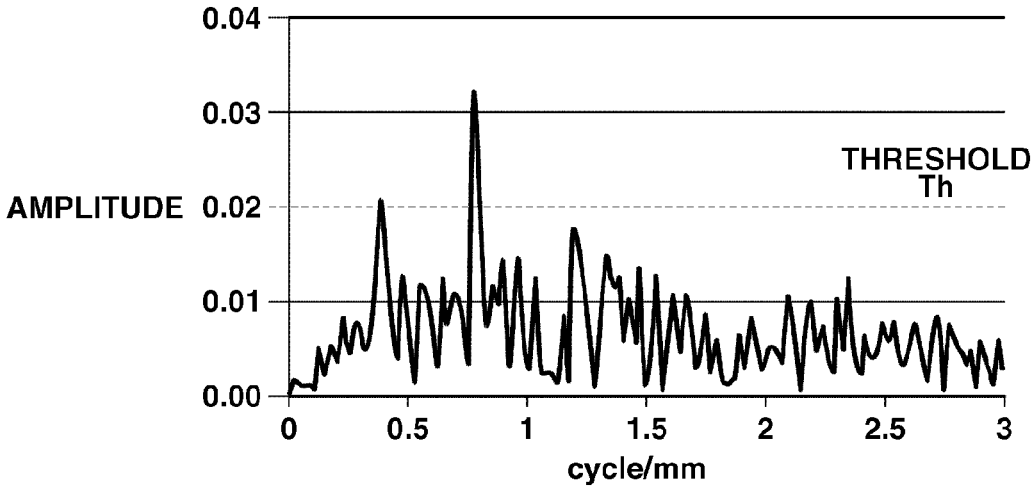
FIGS. 8A and 8B are schematic diagrams illustrating an amplitude spectrum and a module and frequency table, respectively, according to a second exemplary embodiment.

A module frequency storage unit 1105 stores therein a module and frequency table as illustrated in FIG. 8B. Each module has a unique period thereof. Since the module and frequency table depends on design of the image forming apparatus, the table can be readily calculated beforehand.

A module specifying unit 1104 specifies a module as a main cause of the banding. The module specifying unit 1104 analyzes a frequency of the banding that is occurring as a result of measurement of a patch image by the density sensor 120. The module specifying unit 1104 refers to the module and frequency table stored in the module frequency storage unit 1105 based on the analyzed frequency, and specifies the module to be a main cause of the banding.

Figure 4C:
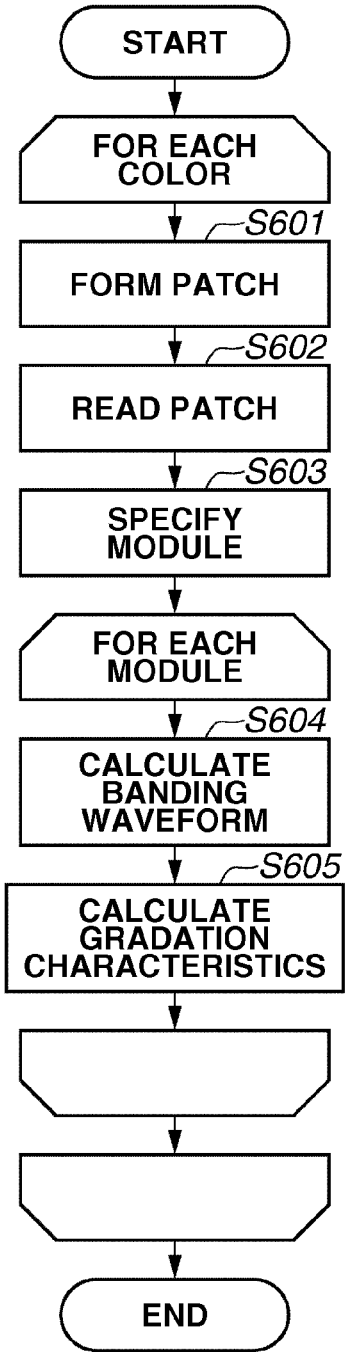

FIG. 4C is a flowchart illustrating a banding characteristic calculation process according to the present exemplary embodiment.

In step S601, a patch forming process is performed as similar to step S401 illustrated in FIG. 4A.

In step S602, a patch reading process is performed. The density sensor 120 detects a density OD in a position y of a patch image transferred to the intermediate transfer belt 101 at every minute interval, and outputs the measurement result to the banding waveform calculation unit 1101 and the module specifying unit 1104.

In step S603, a process for specifying a module as a main cause of the banding is performed.

For example, the module specifying unit 1104 performs a frequency analysis on the density signal OD(y) acquired from the density sensor 120, and calculates a frequency of the banding that is occurring. The module specifying unit 1104 performs the fast Fourier transform (FFT) on the density signal OD(y), and generates a complex sequence F. Subsequently, the module specifying unit 1104 converts the acquired complex sequence F into an amplitude value, and adds the amplitude value to a visual characteristic VTF, thereby determining an amplitude spectrum A(ν).

Equation (6)

$$F = FFT(OD) \tag{6}$$

Equation (7)

$$A(\nu) = |F(\nu)| \cdot VTF(\nu) \tag{7}$$

Equation (8)

$$VTF(\nu) = 5.05e^{-0.138f}(1 - e^{-0.1f}) \tag{8}$$

$$f = \frac{\nu \cdot DPI}{25.4Nj} \cdot \frac{R\pi}{180}$$

Where ν is a frequency, Nj is the number of density signal OD samples (number of measured y), DPI is a resolution at the time of reading the patch by the density sensor 120 in step S602, and R is an observation distance.

Equation (8) is generally known as a visual transfer function (VTF) of Dooley, and represents a visibility of human. More specifically, banding that occurs in a frequency band having a high VTF tends to be noticeable, whereas banding that occurs in a frequency band having a low VTF tends not be noticeable. Thus, a process using Equation (7) is performed to extract the banding in a visually noticeable frequency band. Herein, the complex sequence F is calculated by performing the fast Fourier transform on the density signal OD(y) acquired by measurement. Alternatively, the discrete Fourier transform may be used. FIG. 8A illustrates the amplitude spectrum A(ν) acquired by performing the frequency analysis on the density signal OD(y) by the module specifying unit 1104.

The module specifying unit 1101 compares the amplitude spectrum A(ν) with a threshold Th that is set beforehand, and calculates a frequency ν that is higher than the threshold Th. Herein, assume that the threshold Th is 0.02. In the amplitude spectrum (ν) illustrated in FIG. 8A, the frequencies ν exceeding the threshold Th are 0.400 and 0.796. Such frequencies ν indicate periods of the visually noticeable banding.

Subsequently, the module specifying unit 1104 specifies the module corresponding to the calculated frequency ν from the module and frequency table stored in the module frequency storage unit 1105. As illustrated in FIG. 8B, since each of the modules has a unique period thereof, the module being as a main cause of the banding can be specified from the frequency ν with the high amplitude spectrum A. In the present exemplary embodiment, the modules used for the frequencies ν of 0.400 and 0.769 of the visually noticeable banding are a drum drive gear 2 and a developing roller gear 1 from the table in FIG. 8B. Therefore, the drum drive gear 2 and the developing roller gear 1 can be specified as main causes of the banding. The module specifying unit 1104 outputs the specified drum drive gear 2 and the developing roller gear 1 as correction target modules to the banding waveform calculation unit 1101.

Since the frequency ν is a discrete value which depends on the resolution or the size at the time of the Fourier transform, there are cases where the frequency ν may not match the frequency of each of the modules in the table stored in the module frequency storage unit 1105. In such a case, an amplitude value of the nearest neighbor frequency can be used. Alternatively, a method for acquiring a weighted average of the amplitude values of a plurality of adjacent frequencies may be used.

In step S604, a banding waveform calculation process is performed on the module specified as the main cause of the banding. The processing contents in step S604 are similar to those in step S403 illustrated in FIG. 4A.

There are cases where a module cannot be provided with a rotary encoder or a home position sensor for acquiring a phase from a cost or space standpoint. In such a case, a rotational phase ph and a frequency of a target module can be acquired using a frequency of the other module.

A description is now given of a case where the drum drive gear 2 is specified as a main cause of the banding in step S602. The drum drive gear 2 transmits the power of a drum drive motor to the photosensitive drum, and contributes to a variation in the frequency of twenty times as much as that of the photosensitive drum. In such a case, the banding waveform calculation process is performed on the drum drive gear 2 using a period and a rotational phase ph of the photosensitive drum.

Although the acquired banding waveform of the photosensitive drum has a period of 50 mm (frequency of 0.020 cycle/mm), a variation in a period of 2.5 mm (frequency of 0.400 cycle/mm) of the drum drive gear 2 is included. Accordingly, when periods or frequencies of a plurality of modules can be expressed as an integer ratio, one representative module can be used as a substitute for the other modules.

The latter part of the process is substantially same as the process according to the first exemplary embodiment, and the description thereof is omitted.

According to the present exemplary embodiment, therefore, a module to be a main cause of banding is specified and then corrected, thereby efficiently suppressing the banding.

In step S402 in the above-described exemplary embodiment, the description is made on the method in which a patch image is formed on the intermediate transfer belt 101 and then measured. In an alternative method, density of a patch image may be measured on the photosensitive drum 1001 or a recording medium P. Moreover, a method using an external reading device may be employed.

In the above-described exemplary embodiment, the description is made on the method in which a gradation correction coefficient k to be used in step S404 is set beforehand. In an alternative method, a patch image having a plurality of gradations may be measured when a gradation correction coefficient k differs in each component of the image forming apparatus or when a characteristic of a gradation correction coefficient k changes over time.

Figure 5B:
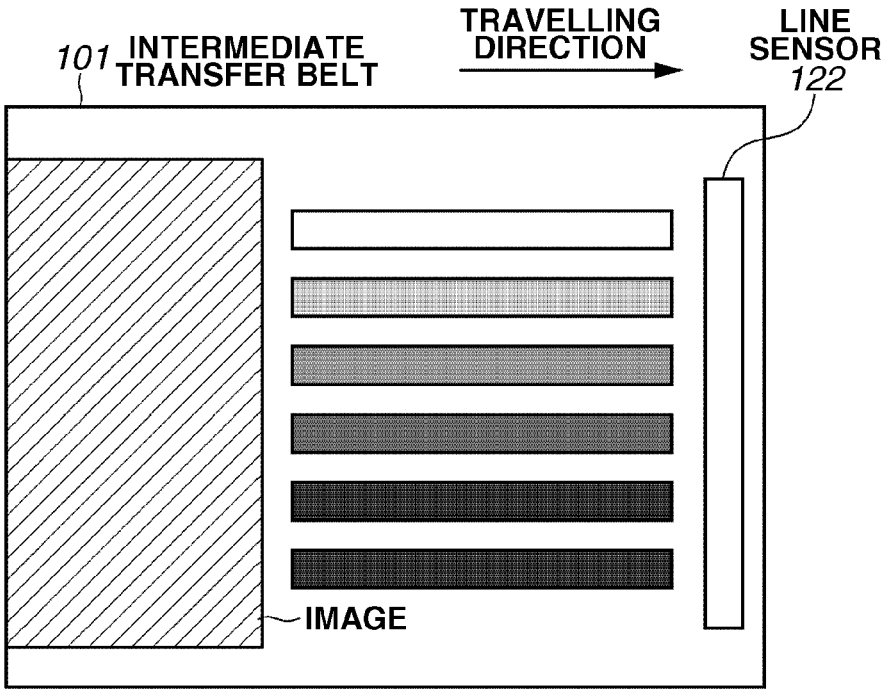

FIG. 5B illustrates a line sensor 122. A patch image having a plurality of gradations may be measured using the line sensor 122 instead of the density sensor 120, and a gradation characteristic of each gradation can be stored. Moreover, a plurality of patch images may be formed and the density sensor 120 may measure a plurality of times in step S402 in the first exemplary embodiment, so that the similar gradation correction coefficient k(ODmean) may be acquired.

In step S404 in the above-described exemplary embodiment, the banding ΔOD(ph, ODmean) in each gradation is calculated by multiplication of the banding waveform ΔOD (ph) by the gradation correction coefficient k(ODmean). When a banding waveform of a specific gradation corresponding to a certain module and a banding waveform of the other gradation do not have a linear relation, a model equation or a conversion table experimentally determined beforehand may be used instead of the gradation correction coefficient k(ODmean).

In the banding characteristic calculation process in the above-described exemplary embodiment, banding characteristics of a plurality of gradations in each mode are calculated from one patch image. In an alternative method, a banding characteristic calculation process may be performed on a specific module first, and then a banding characteristic calculation process may be performed on the other modules based on the corrected patch image provided by the specific module. In another alternative method, a banding characteristic calculation may be performed based on a plurality of patch images to improve gradation characteristic calculation accuracy.

In the module specifying process for specifying a main cause of banding according to the second exemplary embodiment, a module is specified by comparison of the amplitude spectrum and the threshold Th. In an alternative method, for example, the n-th number of modules may be specified in the order of descending amplitude spectrum A.

The present invention can be realized by supplying a recording medium recording a program code of software for realizing the functions of the above exemplary embodiments to a system or an apparatus. In this case, a computer (or a central processing unit (CPU) or a micro processing unit (MPU)) of the system or the apparatus reads and executes the program code stored in the recording medium, and realizes the functions of the above exemplary embodiments.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-127514 filed Jun. 7, 2011, which is hereby incorporated by reference herein in its entirety.

What is claimed is:

1. An image processing apparatus capable of forming an image using a plurality of devices which make periodic movements by an electrophotographic method, the image processing apparatus comprising:

a control unit configured to control image formation using the devices;

a gradation characteristic storage unit configured to store therein a gradation characteristic of each of the devices;

an acquisition unit configured to acquire a phase in each of the devices corresponding to a position of a target pixel;

a calculation unit configured to calculate an amount of density variation caused by each of the devices corresponding to the phase and an input value expressing the target pixel; and a correction unit configured to correct an input value expressing the image based on the density variation amount corresponding to each of the devices, wherein the calculation unit calculates the density variation amount based on the gradation characteristic.

2. The image processing apparatus according to claim 1, further comprising:

a density variation acquisition unit configured to detect density of an image formed using the plurality of devices and acquire variation information expressing a density variation corresponding to the phase of each of the devices, wherein the calculation unit calculates a density variation amount corresponding to each of the devices based on the variation information.

3. The image processing apparatus according to claim 2, wherein the calculation unit calculates density variation amounts corresponding to a plurality of input gradations based on the variation information of the image formed with a specific input gradation; and wherein the correction unit performs a correction according to the phase in each of the devices and the input value.

4. The image processing apparatus according to claim 3, wherein the gradation characteristics of the plurality of devices stored in the gradation characteristic storage unit are calculated based on the variation information.

5. The image processing apparatus according to claim 2, wherein the correction unit performs a correction by subtracting a value provided by integrating the density variation amounts of the respective devices calculated by the calculation unit from the input value.

6. The image processing apparatus according to claim 2, further comprising:

a device specifying unit configured to specify a device to be a main cause of banding based on the variation information; and wherein the calculation unit calculates a density variation corresponding to the device specified by the device specifying unit.

7. A non-transitory computer readable medium configured with instructions to control a device capable of forming an image using a plurality of devices, which make periodic movements comprising:

instructions for storing a gradation characteristic of each of the devices;

instructions for calculating an amount of density variation caused by each of the devices corresponding to a phase of each of the devices and an input value expressing a target pixel of the image; and instructions for correcting an input value expressing the image based on the density variation amount corresponding to one or more of the devices, wherein calculating the density variation amount is based on the gradation characteristic.

8. A method for forming an image for forming an image using a plurality of devices which make periodic movements by an electrophotographic method, the method comprising;

controlling image formation using the devices by a control unit;

storing a gradation characteristic of each of the devices in a gradation characteristic storage unit;

acquiring a phase in each of the devices corresponding to a position of a target pixel by an acquisition unit;

calculating an amount of density variation caused by each of the devices corresponding to the phase and an input value expressing the target pixel by a calculating unit; and correcting an input value expressing the image by a correction unit based on the density variation amount corresponding to each of the devices, wherein the calculating unit calculates the density variation amount based on the gradation characteristic.

* * * * *